US006676335B1

(12) United States Patent
Hickman

(10) Patent No.: US 6,676,335 B1
(45) Date of Patent: Jan. 13, 2004

(54) STRUCTURE JACKING SYSTEM AND METHOD

(75) Inventor: Lowell Hickman, Riverside, MO (US)

(73) Assignee: Dry Basement, Inc., Kansas City, MO (US)

( * ) Notice: Subject to any disclaimer, the term of this patent is extended or adjusted under 35 U.S.C. 154(b) by 0 days.

(21) Appl. No.: 09/707,469

(22) Filed: Nov. 7, 2000

(51) Int. Cl.[7] ..... E02D 5/00; E02D 27/48; E02D 7/10

(52) U.S. Cl. ..... 405/230; 405/229

(58) Field of Search ..... 405/230, 229

(56) References Cited

U.S. PATENT DOCUMENTS

| | | | | |
|---|---|---|---|---|
| 3,852,970 A | | 12/1974 | Cassidy | |
| 4,634,319 A | | 1/1987 | May | |
| 4,673,315 A | | 6/1987 | Shaw et al. | |
| 4,708,528 A | | 11/1987 | Rippe | |
| 4,711,603 A | | 12/1987 | Rippe, Jr. et al. | |
| 4,765,777 A | | 8/1988 | Gregory | |
| 4,800,700 A | | 1/1989 | May | |
| 4,854,782 A | | 8/1989 | May | |
| 4,911,580 A | | 3/1990 | Gregory et al. | |
| 4,925,345 A | | 5/1990 | McCown, Jr. et al. | |
| 5,006,015 A | | 4/1991 | Stephens et al. | |
| 5,123,209 A | | 6/1992 | Nally | |
| 5,135,335 A | | 8/1992 | Stephens et al. | |
| 5,154,539 A | | 10/1992 | McCown, Sr. et al. | |
| 5,171,107 A | * | 12/1992 | Hamilton et al. | 405/230 |
| 5,234,287 A | | 8/1993 | Rippe, Jr. | |
| 5,246,311 A | | 9/1993 | West et al. | |
| 5,492,437 A | | 2/1996 | Ortiz | |
| 5,499,482 A | | 3/1996 | Goff | |
| 5,722,798 A | | 3/1998 | Gregory | |
| 5,800,094 A | | 9/1998 | Jones | |
| 5,951,206 A | | 9/1999 | Gregory | |
| 6,193,442 B1 | * | 2/2001 | May | 405/232 |

* cited by examiner

*Primary Examiner*—Heather Shackelford
*Assistant Examiner*—Sunil Singh
(74) *Attorney, Agent, or Firm*—Shughart Thomson & Kilroy P.C.

(57) ABSTRACT

A structure jacking system for raising a static structure, such as a building, to a desired level with respect to a supporting surface, such as the ground, includes a bracket that is attached to the structure and to a lifting assembly. The lifting assembly drives pier sections into the supporting surface and then elevates the structure once the pier assembly reaches the point of refusal. Once the structure reaches the desired level, the bracket is fixed to the pier assembly to retain the structure at the proper elevation. A preferred embodiment of the bracket includes a ledge having friction elements to inhibit relative movement between the bracket and the structure.

6 Claims, 21 Drawing Sheets

SECTION A-A

SECTION B-B

STRUCTURE JACKING SYSTEM AND METHOD

BACKGROUND OF THE INVENTION

1. Field of the Invention

The present invention relates to the general art of hydraulic and earth engineering, and to the particular field of foundation underpinning. Most particularly, the invention relates to correcting settlement of a static structure, such as a building or element of a building.

2. Description of the Prior Art

As described in U.S. Pat. No. 5,246,311 (West, et al.), the disclosure of which is fully incorporated herein by reference, settling of static structures, such as buildings, is a common phenomenon and can have serious consequences, including damaging or weakening load bearing elements.

As also discussed in the West, et al. patent, the art contains disclosures of various solutions to the aforementioned settling problem. These solutions often include underpinning the structure by driving piers into the ground adjacent to the structure and attaching the structure to those piers after the structure has been elevated to a desired position. For example, one method includes drilling pier holes near strategic sites around the perimeter of a building structure to be repaired and placing piers of concrete to extend from the foundation of the building structure to bedrock and then fixing those placed piers to the building to support the building. While often difficult, heretofore, this was sometimes the only practical method of correcting a settling problem for a structure.

The West, et al. patent discloses a method for correcting the settling problem. The West, et al. patent discloses a system that comprises a plurality of elements each of which performs one of the functions required to correct the building settling problem.

The West, et al. system includes a pier-driving unit that is attached to the structure to be lifted and uses that structure as the base to drive a pier to a point of refusal. The West, et al. system further includes a bracket which is fixed to the building and a secondary system that is attached to the structure-affixed bracket after the pier has been driven to the point of refusal.

The West, et al. secondary system is actuated after the pier-driving unit is removed and, using the pier as a base, lifts the foundation or building to a desired position. The building-affixed bracket is then attached to the pier and the secondary system is removed.

As used herein, the term "point of refusal" means the lowest location beneath the surface of the supporting body, such as the ground, to which an element can be driven using a static structure on the supporting body (ground) as its base against which an element-driving force is exerted. For example, using a building as a base against which pier-driving force is exerted, a pier is driven into the ground supporting the building until the building's weight can no longer provide sufficient support for forcing the pier further into the ground. At that point, further pressure on the pier will no longer drive the pier further into the ground, but, instead, will lift the building. This is the point of refusal.

While the system disclosed in the West, et al patent works well, it can be improved by making that system easier and more efficient to manufacture, set up and use.

Furthermore, there are some situations where the bracket of the West, et al. system cannot be easily used. For example, in some situations, there is not room adjacent to the foundation to provide sufficient clearance for the foundation-supporting elements of the West, et al. system to be placed beneath the foundation. Thus, the foundation cannot be efficiently supported so the pier cannot be efficiently driven into the ground and the foundation efficiently lifted using the system disclosed in the referenced patent. The West, et al. system is not versatile enough to be most efficiently used in such a situation.

Thus, the system disclosed in the referenced West, et al. patent can be improved by making it more versatile. Still further, there are some situations when a foundation has simply dropped away from a building, and the entire building need not be moved, only the foundation needs to be lifted back into position subadjacent to the building. These situations may be fairly simple to remedy. However, the numerous parts of the referenced West, et al. system may somewhat vitiate the ease of correction, especially from a cost-effective basis.

Therefore, the system disclosed in the referenced West, et al. patent can be improved by improving the simplicity thereof and providing a system that is cost-effective in simple operations.

SUMMARY OF THE INVENTION

These, and other objects are achieved by a static structure jacking or lifting system that includes a one-piece, monolithic bracket that is expeditiously attached to the structure to be lifted and to a simple system which is used to drive a pier through a sleeve on the bracket and into the ground beneath the structure to be lifted. The same bracket is used to support the structure during and after raising of the structure to a desired position. The bracket is simply placed beneath the structure to be lifted and is held in place by friction. An alternative bracket is also simple to attach to the structure and is easily attached to the system for raising the structure. The alternative bracket is used in situations where access. subadjacent to the structure is limited or prevented. The alternative bracket is fixed to the structure by attaching means, such as bolts, for attaching the structure to the bracket. However, with the exception of the bracket, which is a simple, one-piece, monolithic element in both cases, the overall system is the same for both situations The one-piece, monolithic configuration of the bracket simplifies the system and makes manufacture thereof efficient while making set up and use more efficient than the system disclosed in the referenced patent. The use of friction or attaching means to fix the bracket to the foundation makes the system embodying the present invention quite versatile as compared to other systems. The simplicity and minimum number of elements of the present system makes it more amenable to simple jobs than prior systems.

OBJECTS AND ADVANTAGES OF THE INVENTION

The principal objects and advantages of the present invention include: providing a structure jacking system and method; providing such a system and method which are efficient to set up and use; providing such a system and method which are adaptable to various field conditions; providing such a system and method which securely grip a foundation wall for raising same; providing such a system and method which provide long-term foundation stability; providing such a system and method which can be used with relatively little training; providing such a system and method which are versatile in application to various foundation conditions; and providing such a system and method which utilize relatively common and easily-fabricated equipment, components and assemblies for installation.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

DETAILED DESCRIPTION OF THE PREFERRED EMBODIMENTS OF THE INVENTION

Other objects, features and advantages of the invention will become apparent from a consideration of the following detailed description and the accompanying drawings.

Figure 5:
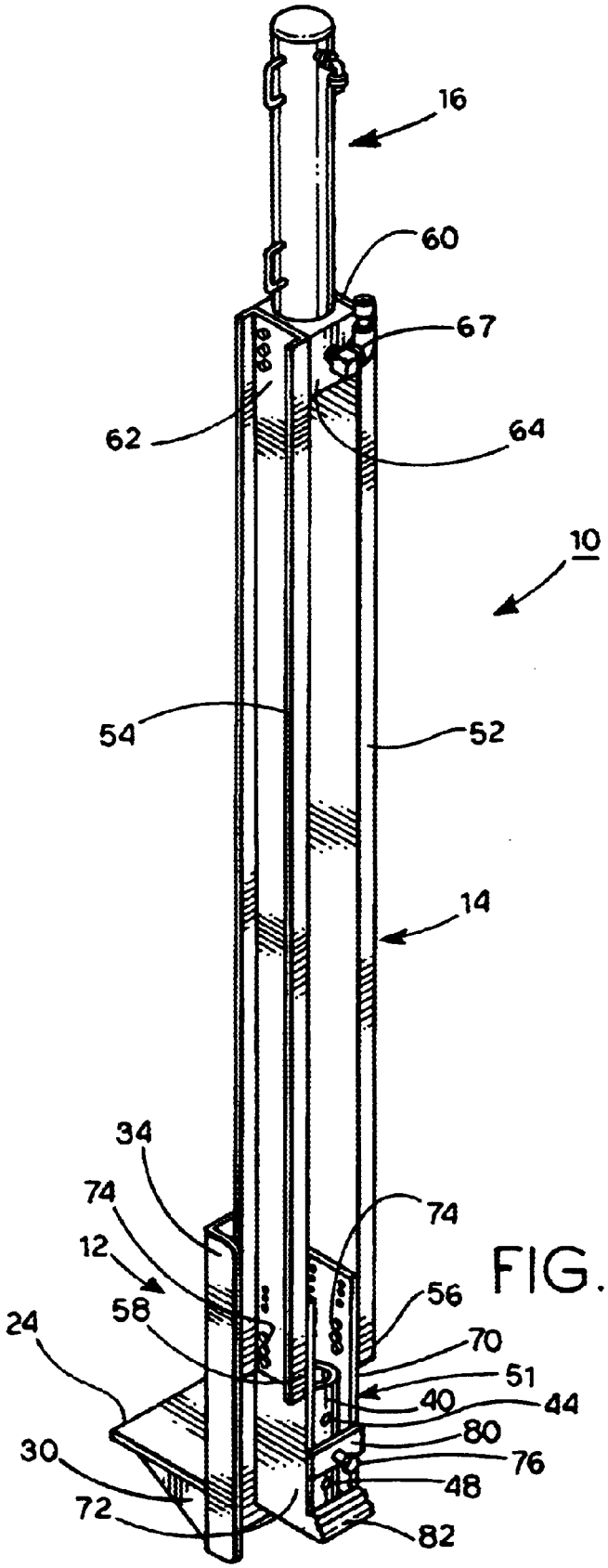
FIG. 5 is perspective view of the bracket in combination with a lifting assembly.
Figure 12:
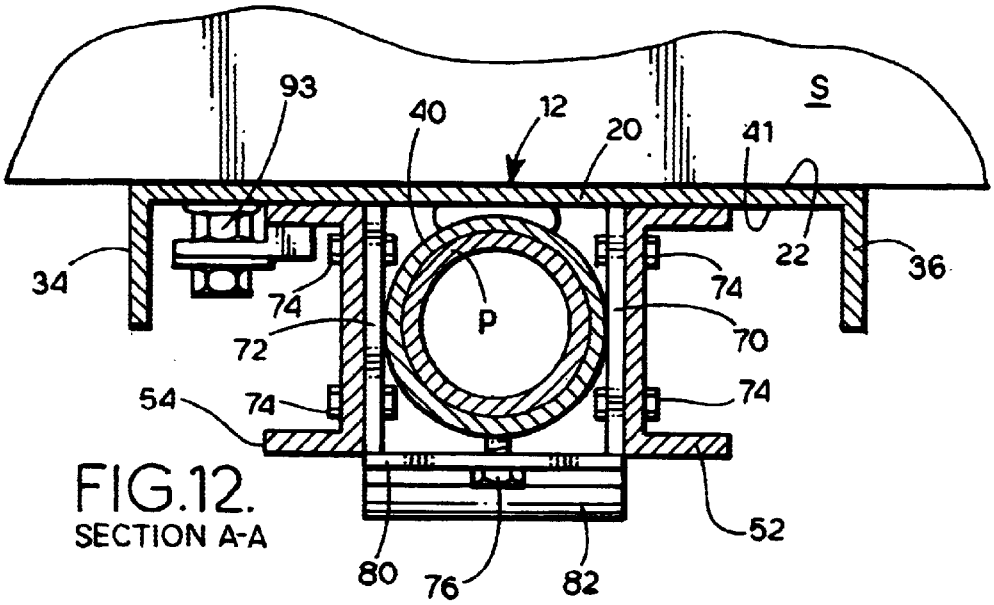
FIG. 12 is a plan view taken along section A—A of FIG. 8.
Figure 13:
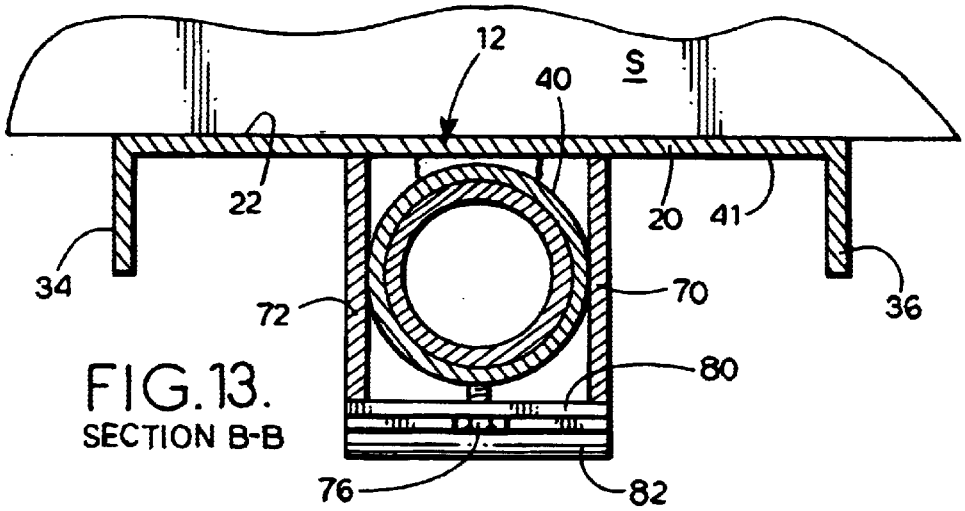
FIG. 13 is a plan view taken along section B—B of FIG. 8.

A system 10 for jacking or elevating a static structure, such as a building or foundation or the like, is shown in FIG. 5 as including a one-piece, monolithic structure-engaging bracket 12 which is fixed to a structure (such as a structure S, not shown in FIG. 5, but which is indicated in other figures, such as FIGS. 12 and 13) to be elevated and to a simple lifting assembly 14 which includes a pier-driving element 16, such as a hydraulic ram or the like. As will be more fully discussed below, a pier (not shown in FIG. 5, but see other figures such as FIGS. 9–11) is driven by pier-driving element 16 of assembly 14 to the point of refusal after which the structure is elevated using assembly 14 and the elevated structure is attached to the pier via bracket 12.

As mentioned above, system 10 is attached to a structure S to be elevated by means of bracket 12, and using structure S as a base against which pier-driving force is exerted, a pier is driven into the ground supporting structure S until the pier reaches a point of refusal. Continued application of pier-driving force elevates structure S with respect to the now stationary pier. When the structure has been elevated to a desired position, the structure-attached bracket 12 is fixed to the pier and lifting assembly 14 is removed. Appropriate backfill and landscaping can then be performed. As also discussed above, system 10 includes a minimum number of simple elements. As such, system 10 is efficient to manufacture, set up and use as well as being versatile and amendable to cost-effective use in simple operations.

Figure 1:
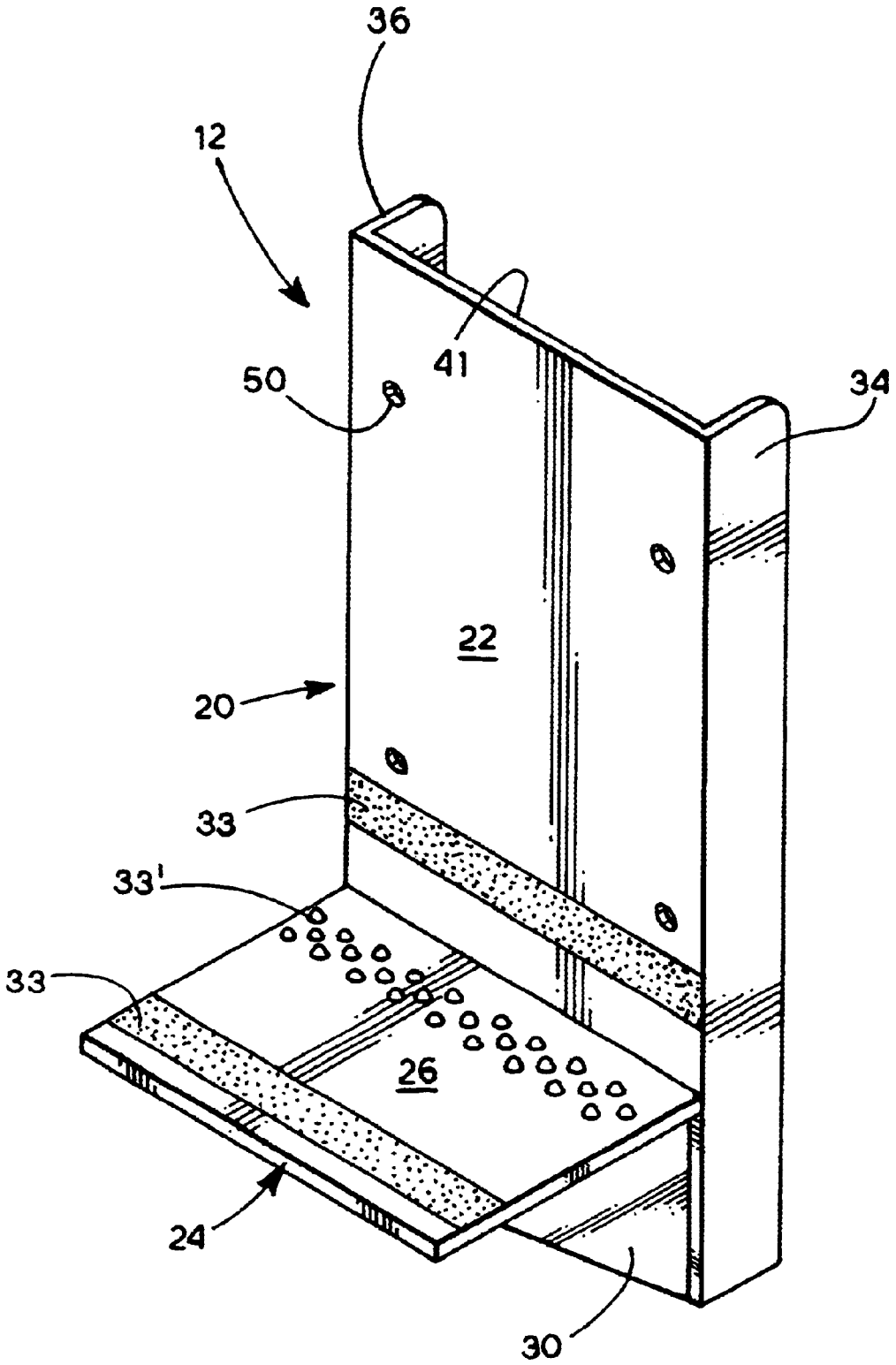
FIG. 1 is a front perspective view of a bracket used in the foundation jacking system embodying the present invention.
Figure 3:
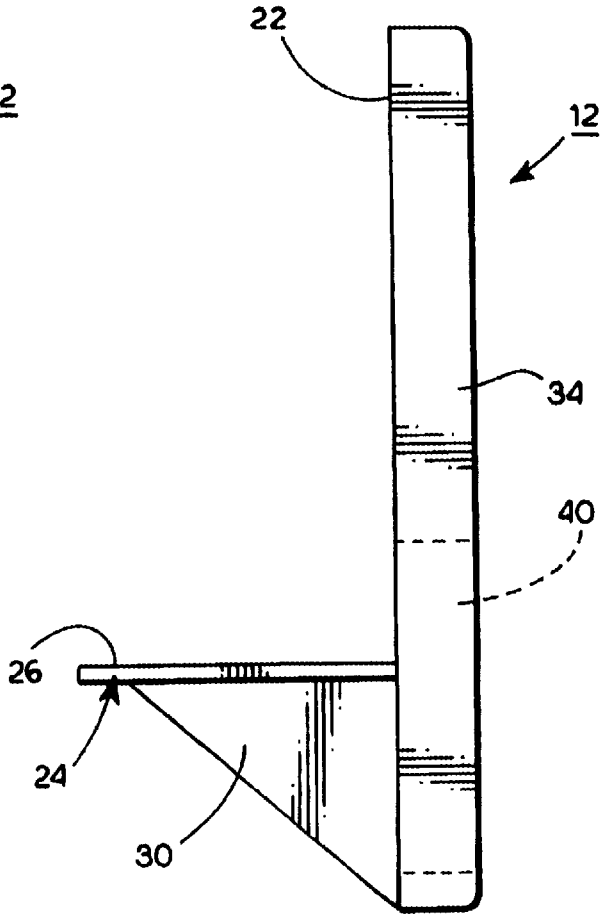
FIG. 3 is a side elevational view of the bracket.
Figure 2:
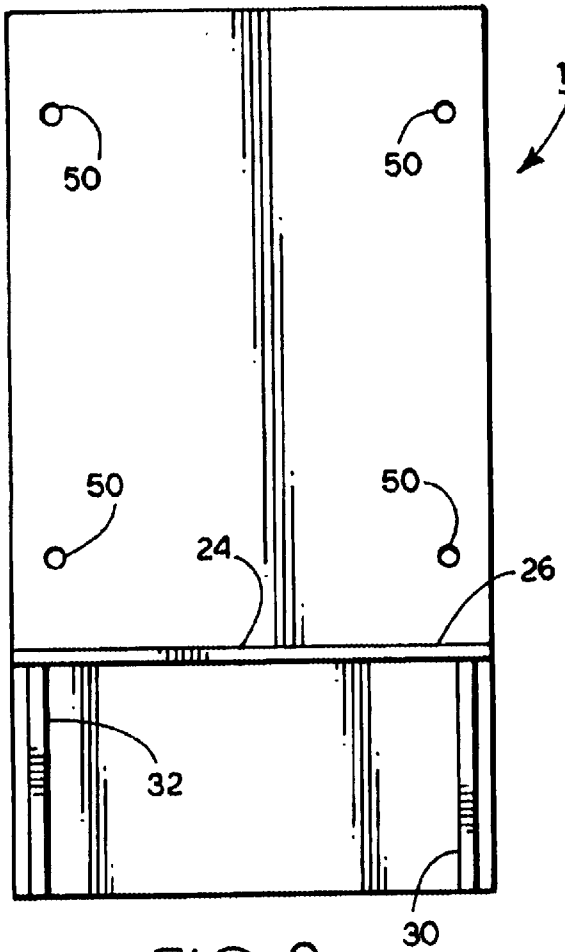
FIG. 2 is a front elevational view of the bracket.

Referring to FIGS. 1–4, it can be seen that one-piece, monolithic structure-engaging bracket 12 includes a body 20 having a surface 22 that will be located immediately adjacent to a side surface of a structure that is to be elevated using system 10 when bracket 12 is in place. A ledge 24 extends outwardly from surface 22 and has a surface 26 which engages a bottom surface of the structure being elevated when bracket 12 is in place on the structure. The structure thus engages bracket 12 at surfaces 22 and 26 and is supported thereon. As can be seen in FIGS. 2 and 3, ledge 24 is also supported by elements, such as ledge-supporting brackets 30 and 32 since ledge 24 will be supporting the weight of the structure.

Bracket 12 further includes friction elements, such as element 33, on surface 26 of ledge 24 to increase the frictional engagement between bracket 12 and the structure being elevated.

The friction elements can be roughened portions of surface 26, such as area 33' or actual strips of frictional material incorporated in ledge 24 as suitable.

In one form of system 10, the means for attaching the structure to bracket 12 consists entirely of the frictional engagement between the structure and bracket 12. This makes the overall system efficient to manufacture and to use. The frictional engagement between the bracket and the structure can be increased by placing friction elements, such as friction strip 33 or defining roughened area 33' on each surface of the bracket that engages the structure, including surface 22 of body 20. Any suitable material can be used for friction strips 33' and one skilled in the art of materials will understand what the best material is. Therefore, no specific material will be described herein. Any suitable roughness factor can be used for the roughened areas as well.

Figure 4:
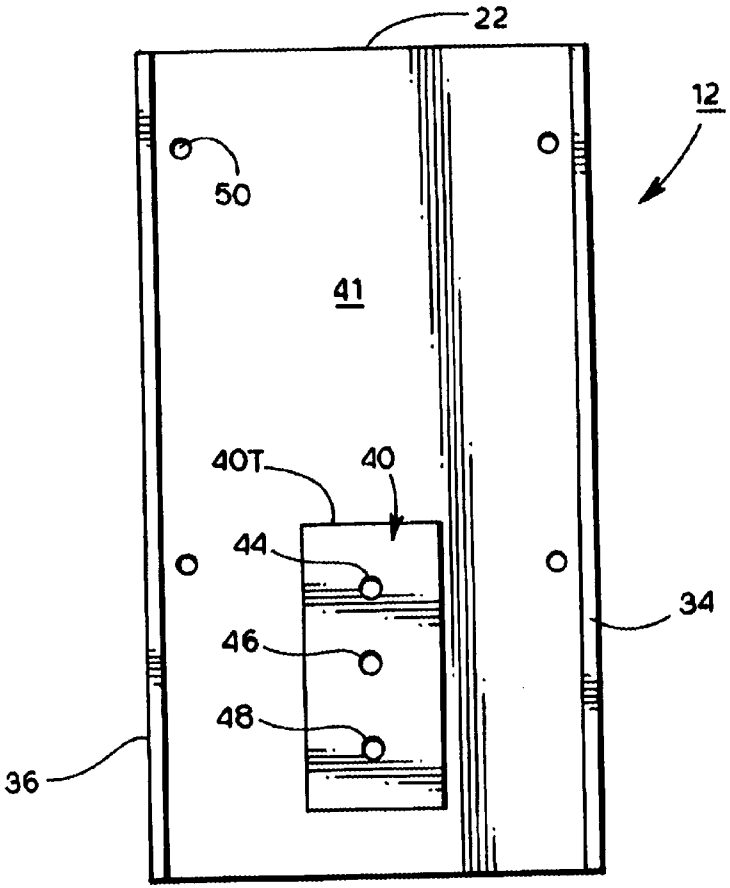
FIG. 4 is a rear elevational view of the bracket.

As is best shown in FIGS. 1, 3 and 4, bracket 12 also includes two side channel elements 34 and 36 as well as sleeve 40. Sleeve 40 is hollow and preferably is cylindrical and is sized to have an inner diameter that will slidably accommodate a pier that is used to elevate and support the structure. Sleeve 40 is located on rear surface 41 of body 20 and has an outer diameter that is essentially equal to the width dimension of the side channel elements 34 and 36 and thus is not visible in FIGS. 1 and 3, but is indicated in phantom lines in FIG. 3.

Holes 44, 46 and 48 are defined through sleeve 40 in a radial direction and serve a purpose that will be understood from the ensuing disclosure. Further holes, such as hole 50, are defined through body 20 adjacent to side channels 34 and 36 for further affixing bracket 12 to the structure if desired. Suitable fasteners, such as are used in the building industry can be used to fix bracket 12 to the structure. As will be understood from the teaching of this disclosure, the three holes 44, 46 and 48 are easily used in a variety of situations and thus provide system 10 with versatility and simplicity.

One-piece bracket 12 is formed of materials used in the building industry and which are strong enough to carry out the function of bracket 12. The one-piece, monolithic nature of bracket 12 makes it extremely strong while remaining efficient to manufacture reliable and cost effective.

Referring next to FIGS. 5–9, lifting assembly 14 is seen to include a cage assembly 51 which connects lifting assembly 14 to bracket 12 during a pier driving step and a structure elevating step. Lifting assembly 14 further includes two straps 52 and 54 which are each attached at lower ends 56 and 58 to cage assembly 51 and at upper ends 60 and 62 respectively to a cross brace 64 which supports a pier-driving element 66 thereon.

Cage 51 includes two side elements 70 and 72 which are respectively connected to straps 52 and 54 as by bolts 74 or the like, and which are attached to sleeve 40 by a fastener, such as a bolt 76 extending through a hole defined in a cross strap 80 which is part of side elements 70 and 72 and is engagingly fixed to sleeve 14 via hole 46 in sleeve 40. A bottom shoe 82 is also included in cage 51.

Figure 6:
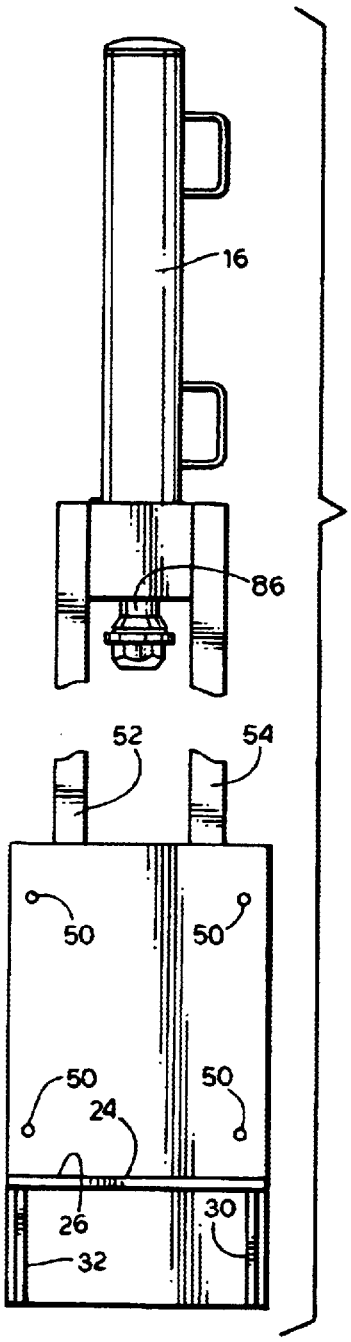
FIG. 6 is a front elevational view of the bracket in combination with the lifting assembly with a portion of the lifting assembly broken away for clarity of illustration.
Figure 7:
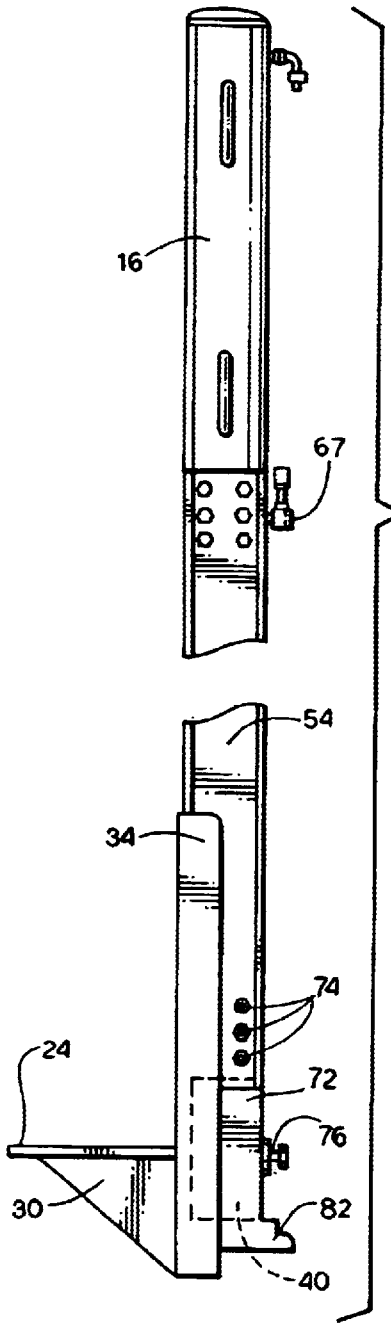
FIG. 7 is a side elevational view of the bracket in combination with the lifting assembly.
Figure 8:
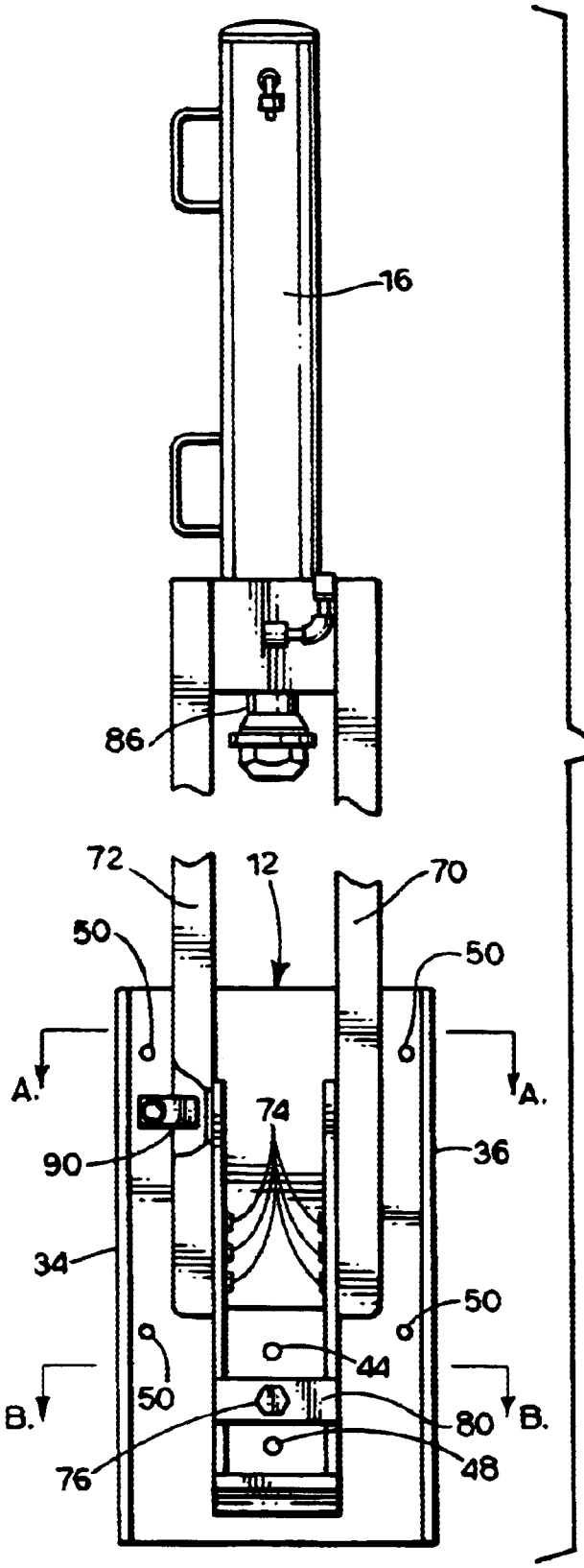
FIG. 8 is a rear elevational view of the bracket in combination with the lifting assembly.
Figure 9:
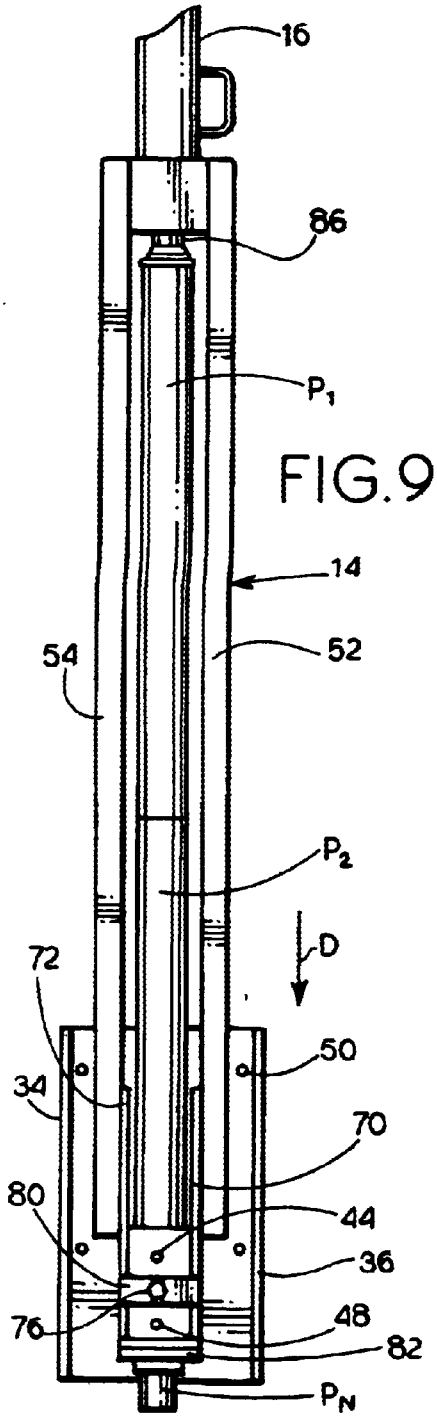
FIG. 9 is a rear elevational view of the foundation jacking system embodying the present invention in a lift/drive configuration with a pier in place and the bracket connected to the lifting assembly.
Figure 11:
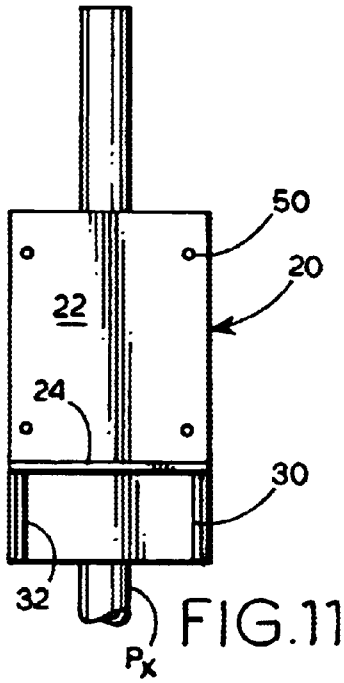
FIG. 11 is a front elevational view of the bracket affixed to a pier in a foundation-supporting configuration.
Figure 10:
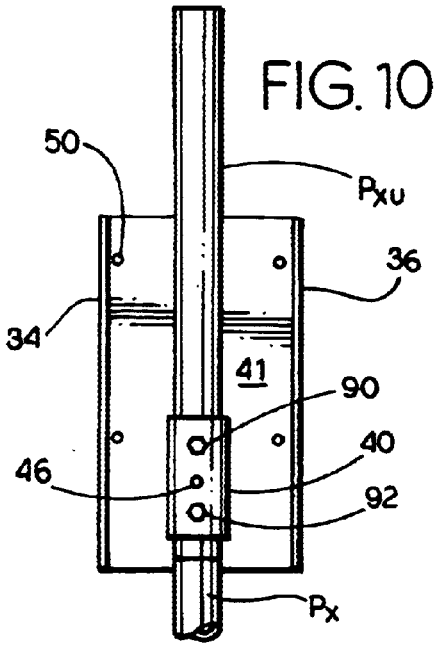
FIG. 10 is a rear elevational view of the system in a structure support configuration with the bracket affixed to a pier.

Referring to FIGS. 5, 6 and 9, pier-driving element 16 includes a ram 86 which engages an upper or superior end of a pier section to drive that pier section into the ground in a manner well known to those skilled in the well drilling art. Pier-driving element 16 includes appropriate fluid and electrical circuits and systems, as will be known to those skilled in the well drilling and earth engineering arts. A fluid line 67 is indicated in FIG. 5 by way of example only. The pier section is driven through sleeve 40 in direction D. When the pier section has reached its limit with respect to lifting assembly 14, another pier section is inserted into assembly 14 between straps 52 and 54 so the lower or inferior end of the newly-inserted pier section abuts the superior end of the just-driven pier section and the superior end of the newly-inserted pier section is engaged by ram 86. Suitable locking elements can be used to fix one pier section to adjacent pier sections. Section locking elements are well known to those skilled in the well drilling art and will not be discussed and are not shown in the figures for ease of illustration. Pier sections are inserted as needed until the overall pier assembly, which now comprises a plurality of pier sections as will be understood by those skilled in the well drilling art, is driven to the desired depth or to the point of refusal. The pier sections are indicated in FIGS. 9–11 as pier section P1 being the newly-inserted pier section, pier section P2 being the just-driven pier section and pier section PN being a previous pier section that has been driven and is engaged by a pier section still in lifting assembly 14. As indicated in FIGS. 10 and 11, a final pier section Px is the pier section slidably accommodated in sleeve 40 when the overall pier assembly reaches the point of refusal.

Bracket 12 is fixedly attached to the pier assembly by means of a fastener, such as bolts 90 and 92, being placed through holes 44 and 48 in sleeve 40 and into fixing engagement with pier section Px as indicated in FIG. 10. Any portion of pier section Px extending above sleeve 40, indicated in FIG. 10 as portion Pxu, can be removed by simply cutting that portion off above sleeve 40 if desired.

Once the structure has been elevated and affixed to the pier assembly, lifting assembly 14 can be removed from attachment to bracket 12 and then completely removed from the area. Backfill, landscaping, and the like can then be performed such as discussed in the referenced West, et al. patent and as known to those skilled in the art of hydraulic and earth engineering.

As will be understood from the foregoing, bracket 12 can be further affixed to the structure by bolts or the like extending through holes 50 in body 20. One or more spacers, such as spacer 93 shown in FIG. 12, can also be used to further ensure proper positioning of bracket 12. The spacers are not shown in FIG. 9 for clarity of illustration.

Figure 18:
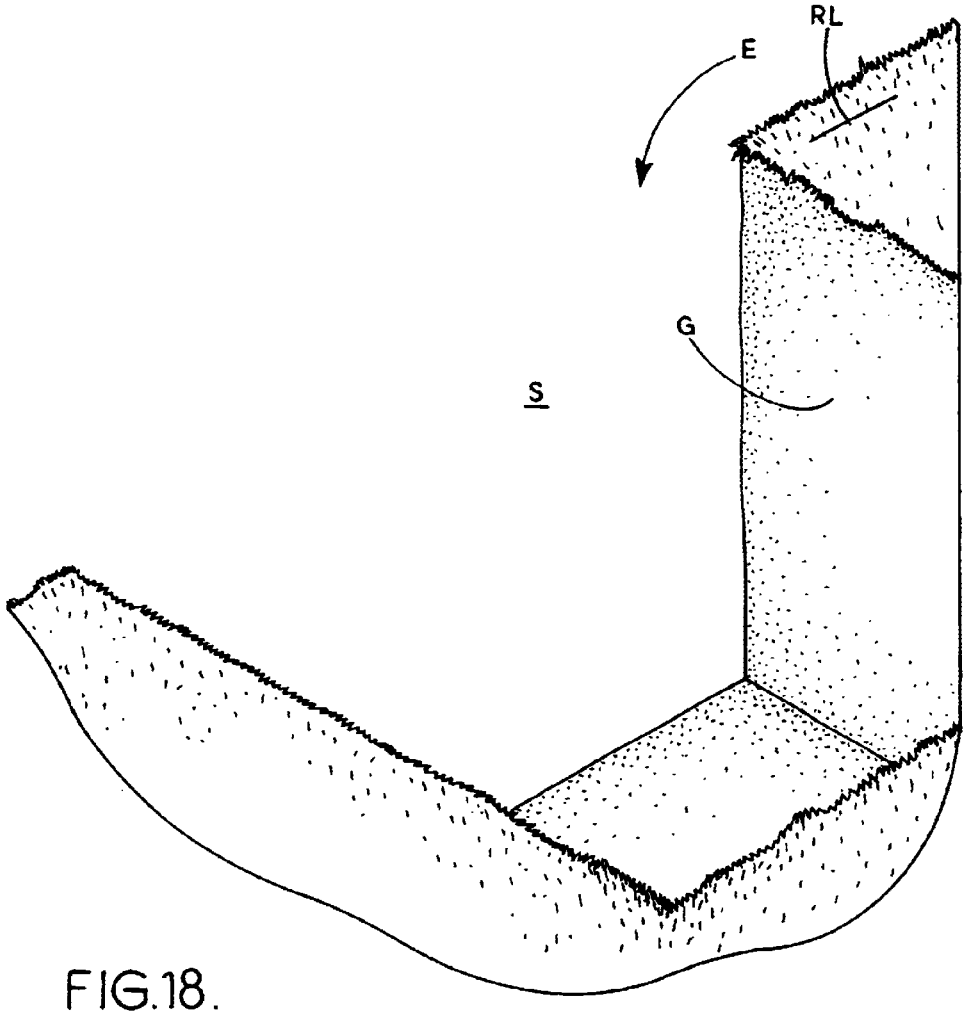
FIG. 18 illustrates an excavated area adjacent to a structure to be elevated as a first step in carrying out the method embodying the present invention.

As will be best understood from FIGS. 18–18E, the operation of the system 10 is as follows.

Figure 18A:
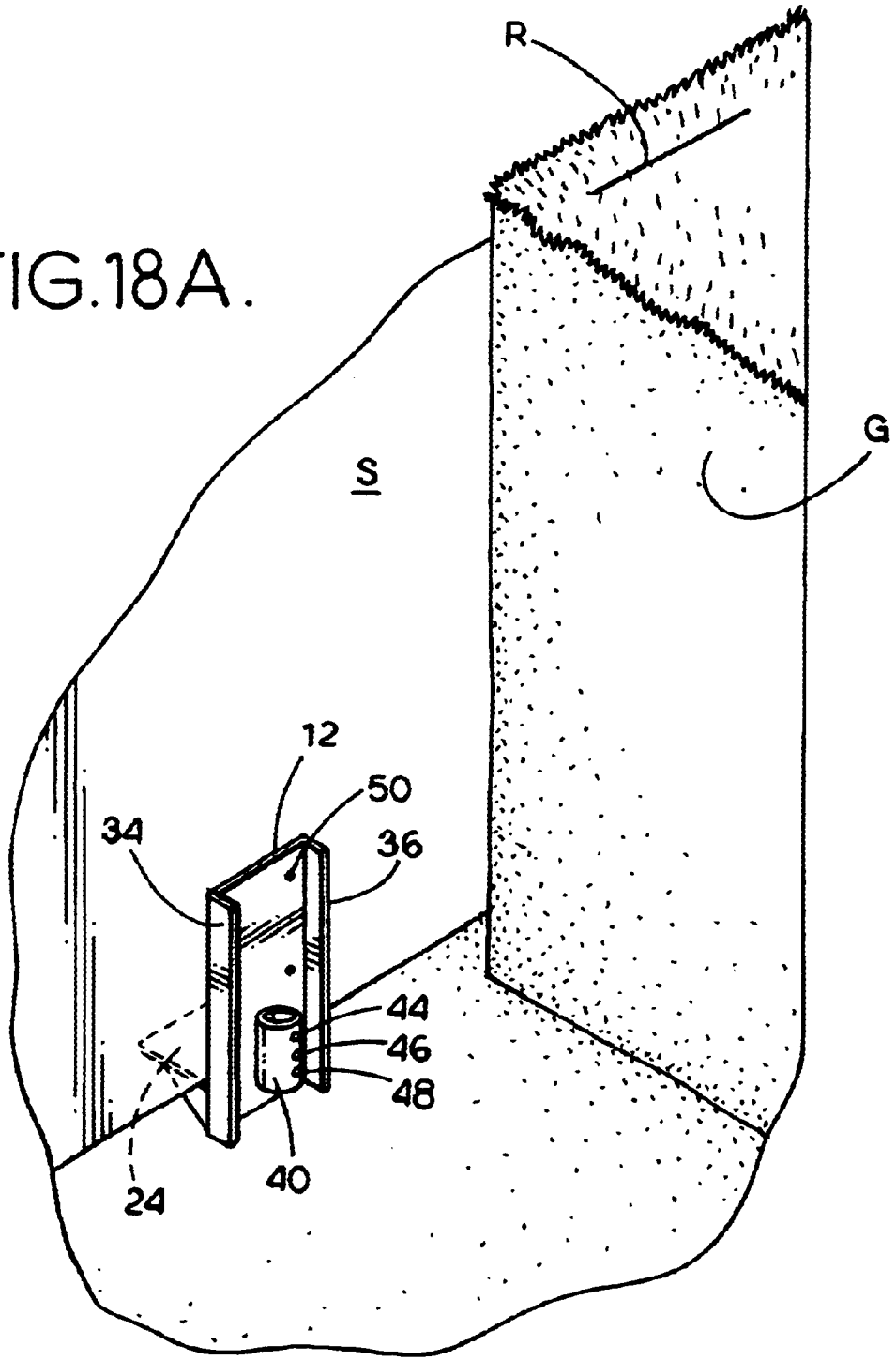
FIG. 18A illustrates a bracket positioned in a lifting configuration adjacent to the structure as a step in the method of the present invention.
Figure 18B:
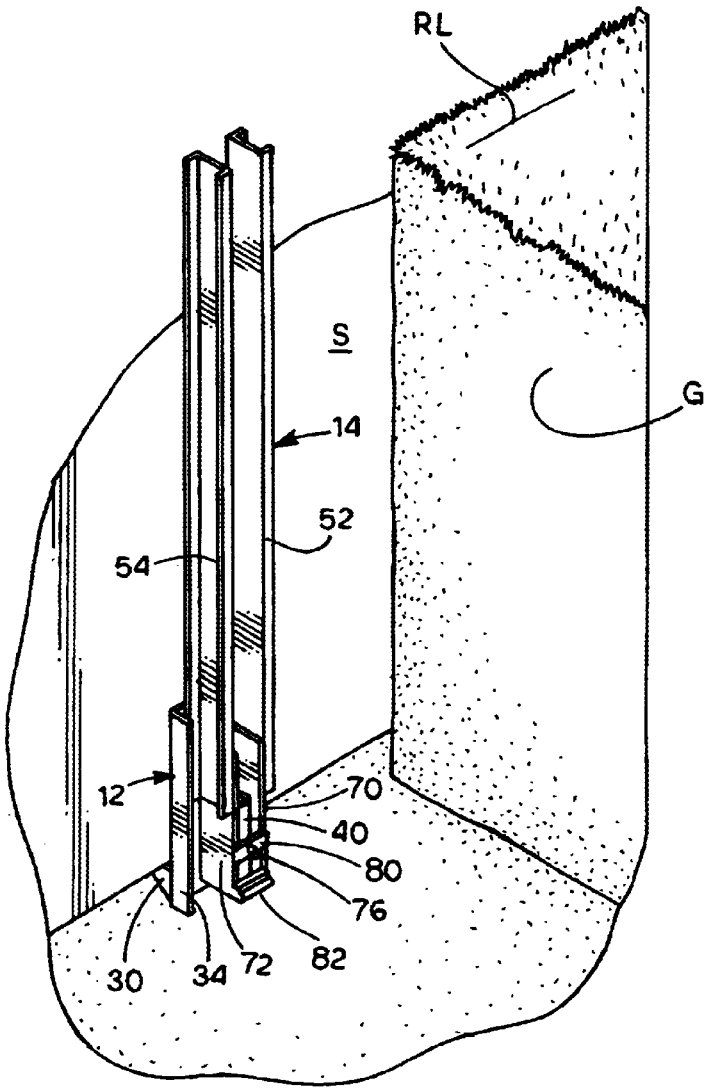
FIG. 18B illustrates a lifting assembly connected to the in-place bracket as a step in the method of the present invention.
Figure 18C:
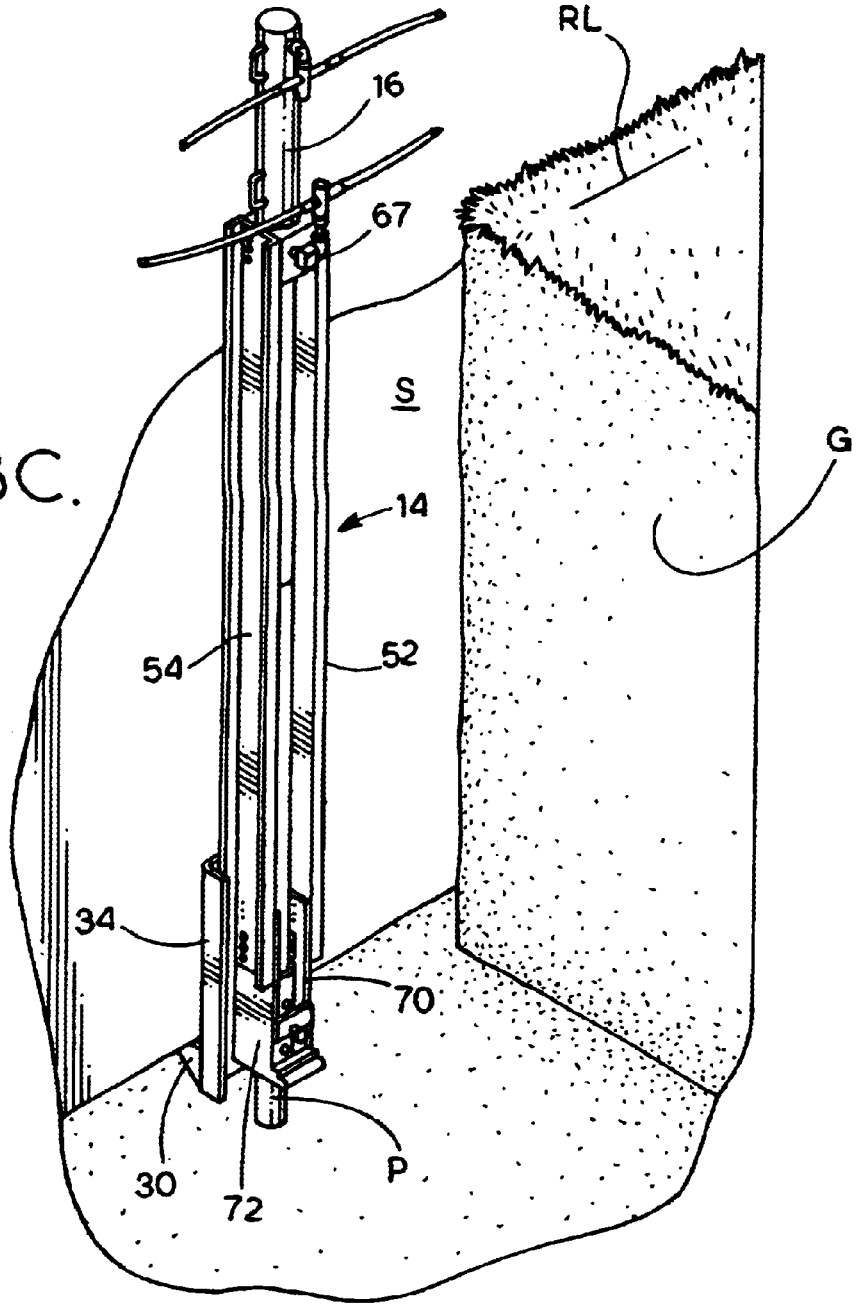
FIG. 18C illustrates a pier driver mounted on the lifting assembly and piers in position to be driven into the ground supporting the structure as well as a pier driven into the ground as a step in the method of the present invention.
Figure 18D:
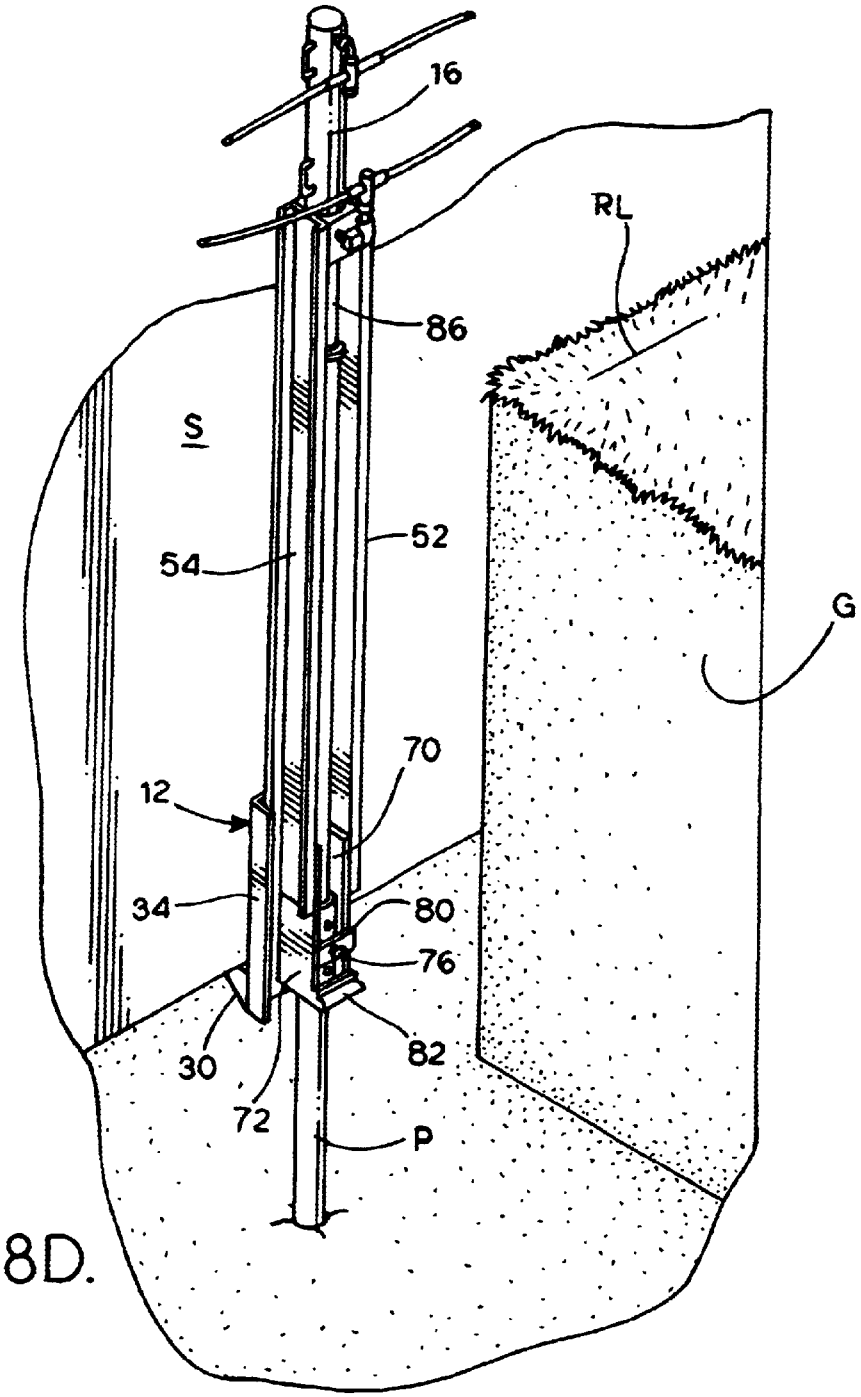
FIG. 18D illustrates the step of the method of the present invention in which the structure has been elevated after the piers have been driven into the ground to the point of refusal.
Figure 18E:
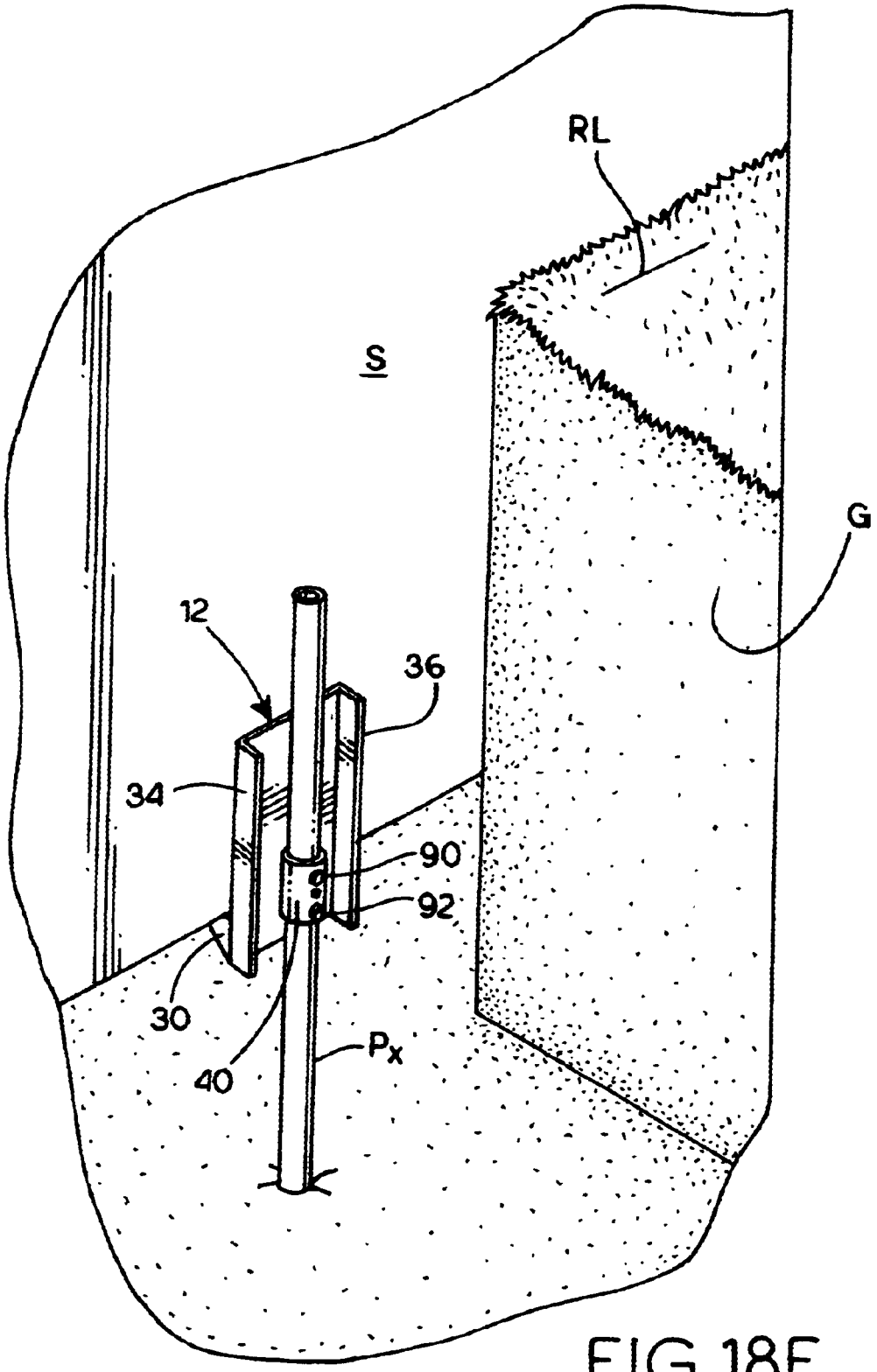
FIG. 18E illustrates a step in the method of the present invention in which the lifting assembly has been removed and the bracket is affixed to the pier assembly and to the structure to hold the structure in the desired elevated position.

After proper excavation E is defined adjacent to a structure S to be elevated (see FIG. 18) with respect to a reference level RL on supporting means such as ground G, bracket 12 is positioned as illustrated in FIG. 18A with ledge 24 immediately subadjacent to a bottom surface of the structure and, as illustrated in FIG. 18B, lifting assembly 14 is attached to bracket 12 via cage 51, cross strap 80, fastener 76 and fastener-receiving hole 46. Reference level RL can be established using a method and equipment known to those skilled in the surveying art based on the teaching of this disclosure. As indicated in FIG. 18C, a first pier section is inserted between straps 52 and 54, ram 86 and slidably through sleeve 40 and into the ground supporting the structure. Frictional engagement is sufficient to hold the ledge of bracket 12 in place beneath structure S. Once all is in place, pier-driver 66 is activated to use the structure as a base against which to drive, and to drive the pier sections through sleeve 40 and into the ground until the point of refusal is reached. As illustrated in FIG. 18D, at that time, force on the pier sections is applied to elevate the structure to the desired level with respect to the ground, or other such supporting body. After the structure has been elevated, as illustrated in FIG. 18E, bracket 14 is fixedly attached to the last pier section via sleeve 40 with fasteners, such as bolts 90 and 92, or the like, extending through holes 44 and 48 in sleeve 40 and into fixed engagement with the pier section Px.

Once bracket 12 is fixed to the pier section, lifting assembly 14 is removed. Additional fasteners, such as bolts or the like, can be used to further attach bracket 12 to the structure via holes 50 in body 20. The final assembly is shown in FIGS. 10 and 18E, and the top section of pier section Px can be removed if desired to make the top of the last pier section flush with the top end edge 40T (see FIG. 4) of sleeve 40. Backfill, and the like can then be placed around the bracket as discussed in the referenced West, et al. patent.

As discussed above, some situations prevent or severely restrict the use of a bracket having a ledge, such as ledge 24.

Figure 16:
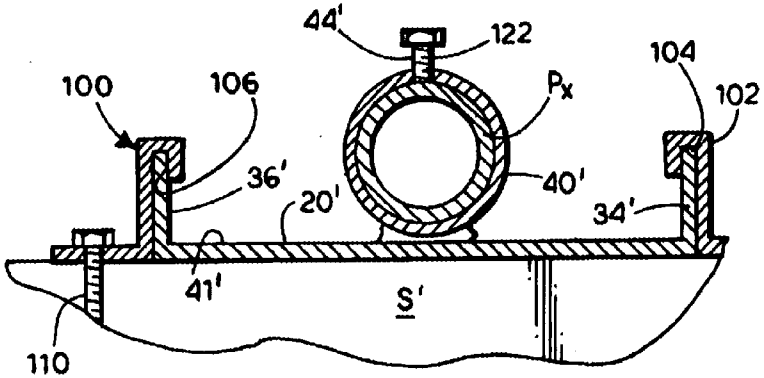
FIG. 16 is a plan view taken along line 16—16 of FIG. 15.
Figure 15:
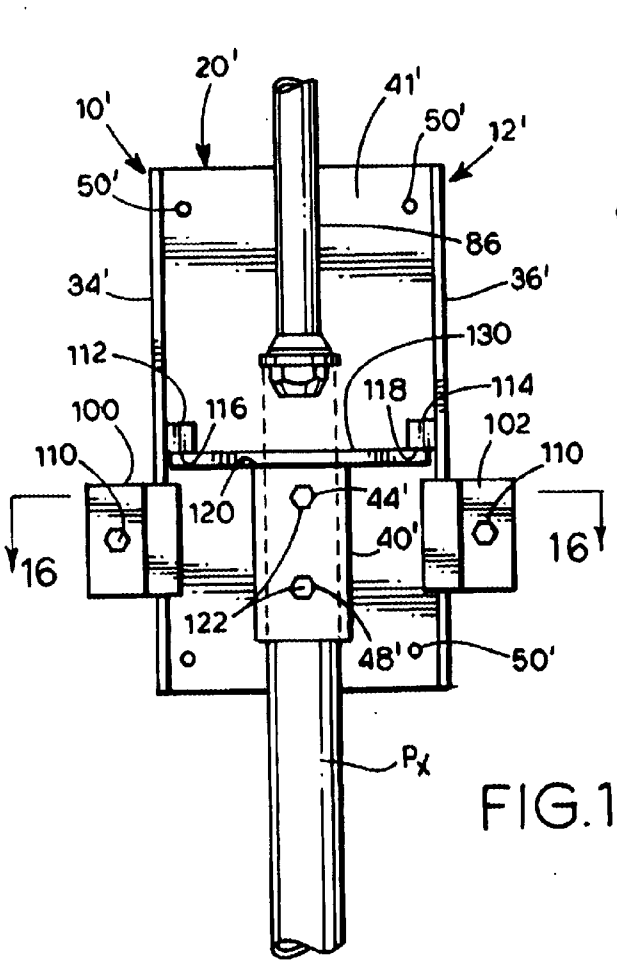
FIG. 15 is a rear elevational view of another alternative form of the system which is used in situations where there is very little or no clearance beneath the structure to be elevated.

System 10 works well in such situations and needs only a slight modification to the bracket assembly. The modification is shown in FIGS. 15 and 16 and is indicated as system 10'. Alternative system 10' includes a one-piece, monolithic bracket 12' that is fixed to a structure S' (see also FIGS. 19A–19E), such as a building or a foundation or the like, to be elevated and which is used in connection with lifting assembly 14. Lifting assembly 14 is as described above. Bracket 12' has been modified to account for the restrictive condition that there is no room subadjacent to structure S' to accommodate a ledge such as ledge 24 of bracket 12. Accordingly, bracket 12' has no ledge. In order to fix bracket 12' to the structure to be elevated, guide brackets 100 and 102 are fixed to structure S' and have channels 104 and 106 to slidably accommodate side channel elements 34' and 36' which extend rearwardly from surface 41' of body 20' of bracket 12' as is best seen in FIG. 16. Fasteners, such as bolt 110, are used to attach brackets 100 and 102 to the structure.

Additional fasteners can be used and extend through holes in the bracket body 20' as indicated at hole 50' in FIG. 15 to further fix bracket 12' to the structure.

Bracket 12' includes a sleeve which is similar to sleeve 40 and slidably receives pier sections in the manner described above. The pier sections are driven by pier-driving element (not shown in FIG. 15, but see, FIG. 5) having a ram 86 in the manner described above. As shown in FIG. 15, bracket 12' further includes two abutment elements 112 and 114 positioned to have the end edges 116 and 118 respectively located immediately superadjacent to a plane containing end edge 120 of sleeve 40' when bracket 12' is in a structure elevating orientation. Sleeve 40' has two holes 44' and 46' each of which accommodates a fastener, such as bolt 122 to temporarily fix bracket 12' to a pier section Px after the structure has been elevated as will be understood from the following discussion.

Pier sections are driven into the ground supporting the structure in the manner discussed above with reference to system 10 until a point of refusal is reached. At that time, further driving force applied to the pier assembly will elevate the structure. Once structure S' is elevated, or jacked, to the desired height with respect to the ground, bolts 122 are inserted through holes 44' and 46' to temporarily fix bracket 12' to the pier system via pier section Px as is indicated in FIG. 15.

After the temporary attachment of the bracket to the pier system, the lifting assembly is removed, and pier Px is cut off flush with end edge 120 of sleeve 40'. A stop plate 130 is interposed between ends 116 and 118 and end 120 as indicated in FIG. 15. Stop plate 130 is formed of very heavy material and will support the structure on the pier system as bolts 90 and 92 support the structure on the pier system in system 10 as described above Once. stop plate 130 is in place, bolts 122 can be removed as can guide brackets 100 and 102 if desired.

Figure 19A:
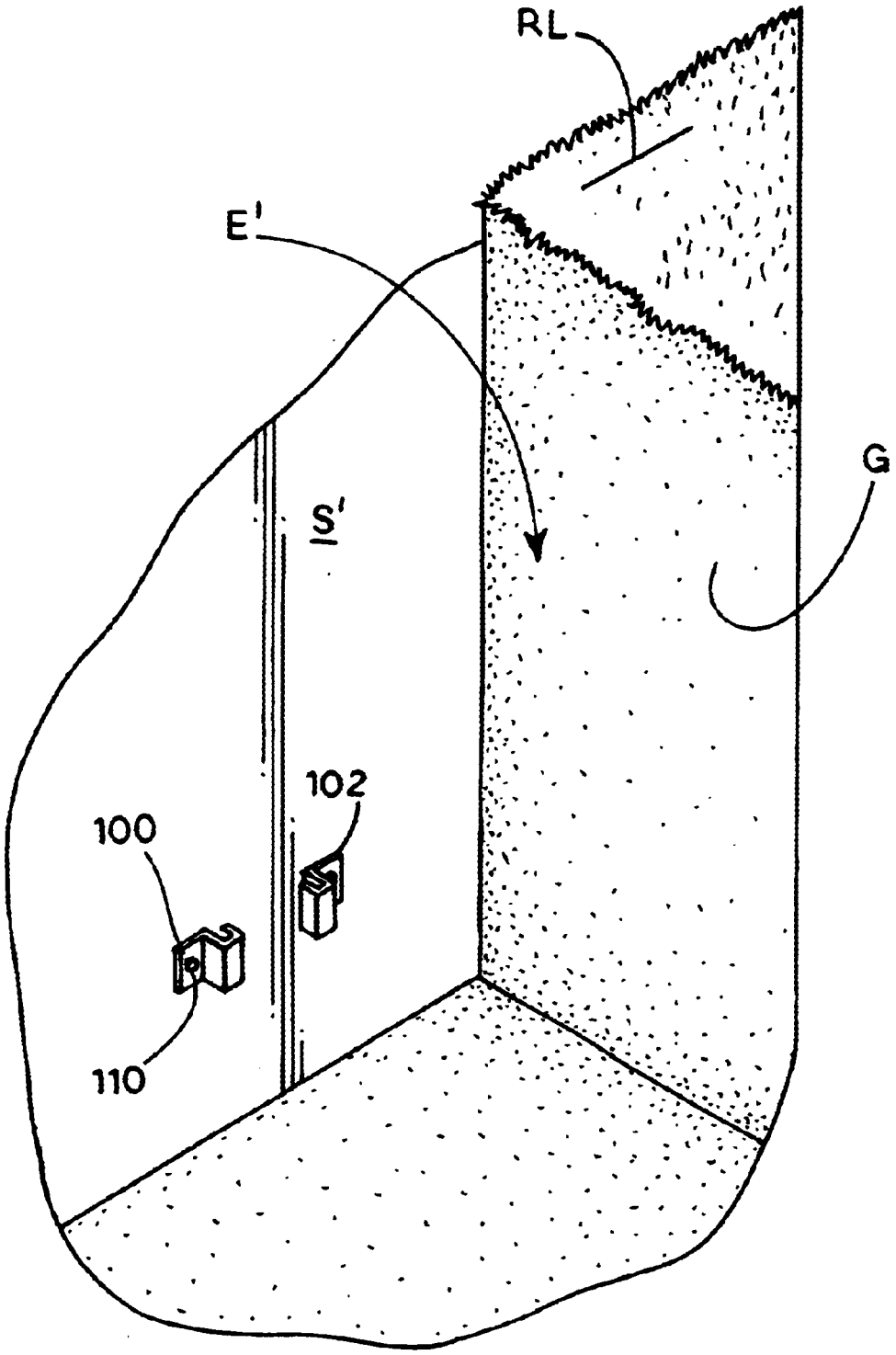
FIG. 19A illustrates a step in the method of the present invention after an area adjacent to the structure to be jacked has been excavated and in which an alternative form of the bracket is used.
Figure 19B:
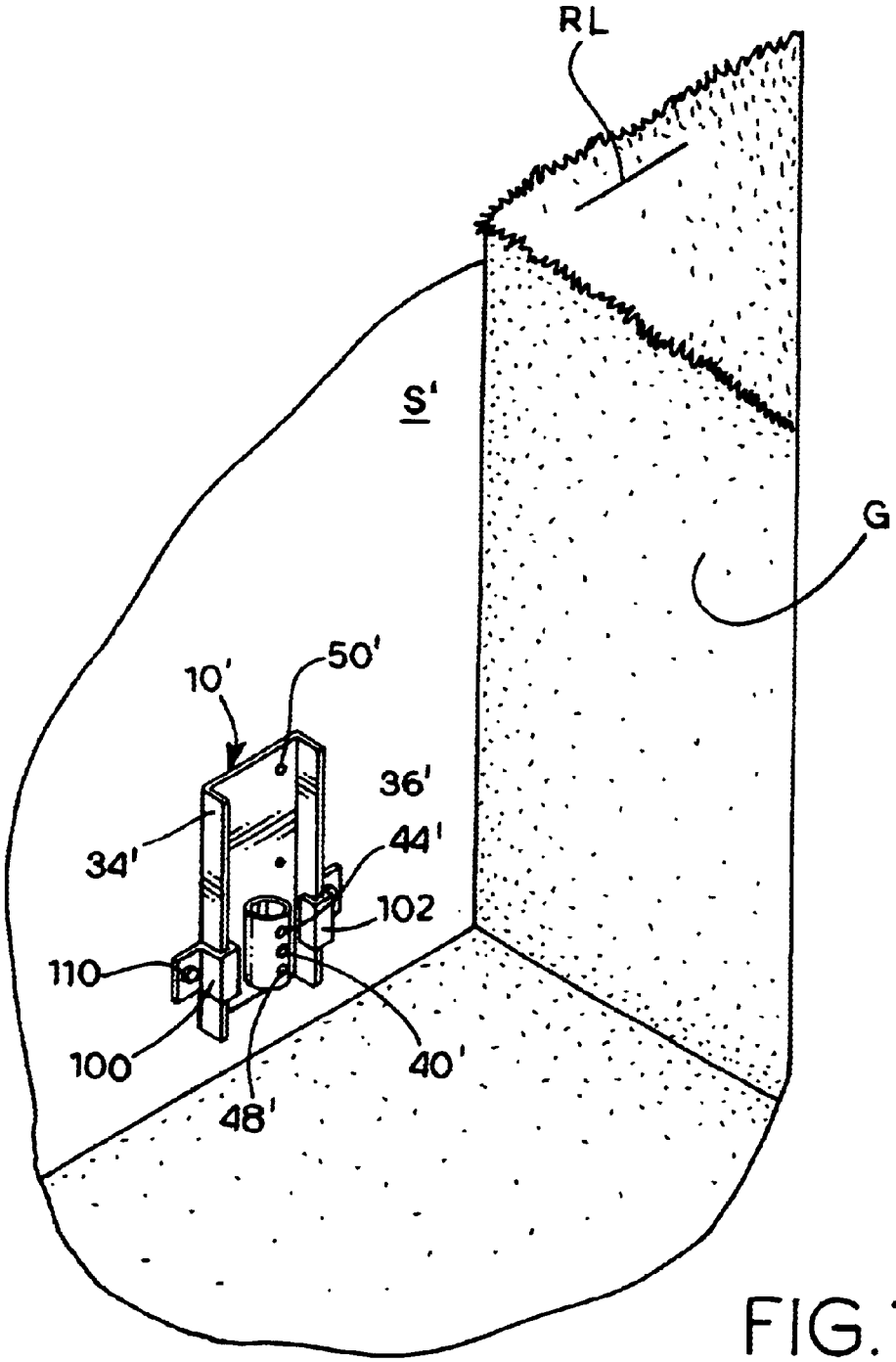
FIG. 19B illustrates another step in the method of the present invention in which a bracket is affixed to the structure to be lifted.
Figure 19C:
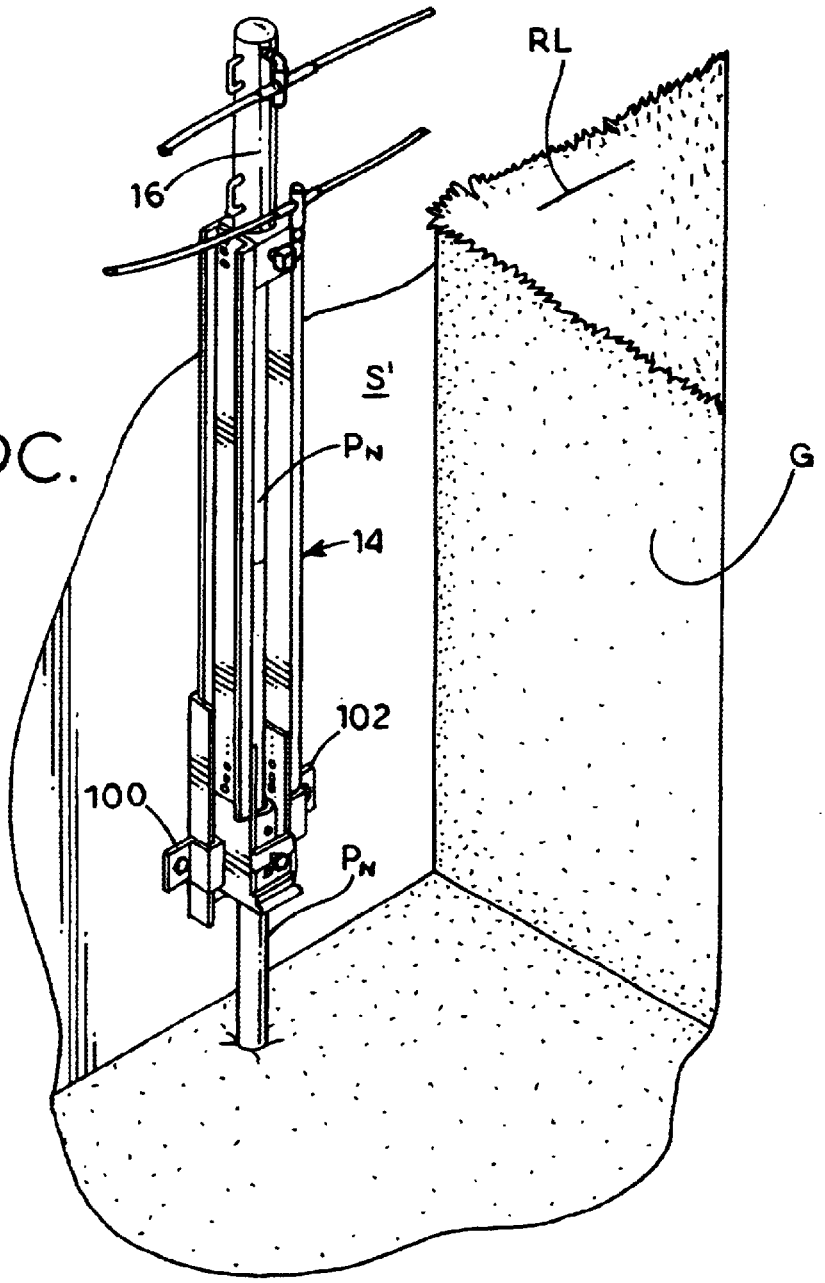
FIG. 19C illustrates another step in the method using the alternative form of the invention in which a lifting assembly is attached to the alternative form of the bracket and piers are driven into the ground supporting the structure.
Figure 19D:
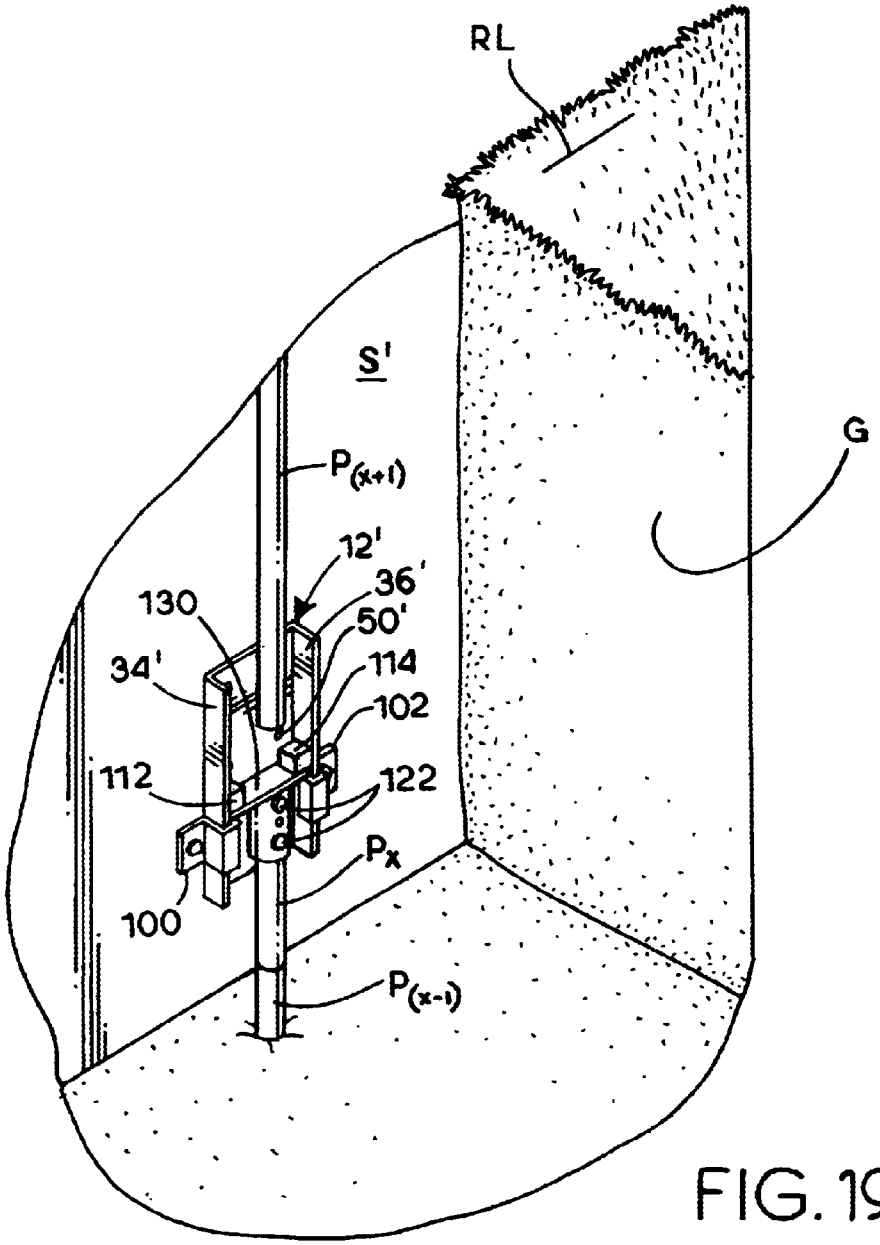
FIG. 19D illustrates another step in the method using the alternative form of the bracket in which the building has been elevated to its desired height with respect to the ground, and the topmost pier is cut off flush with the topmost edge of the sleeve on the bracket and a pier stop plate has been inserted to hold the bracket on the pier assembly.

The method of elevating or jacking structure S' with respect to a reference level RL on supporting means such as ground G, using system 10' is illustrated in FIGS. 19A–19E. It is noted that reference level RL can be established in using any method known to one skilled in the surveying art. As shown in FIG. 19A, after appropriate excavation E' adjacent to structure S' to be elevated, guide brackets 100 and 102. Next, as indicated in FIG. 19C, lifting assembly 14 is attached to bracket 12' in the manner described above with regard to system 10 (see, e.g., FIG. 5), pier section are placed as describe above, and are driven into the ground using pier-driver 16 to the point of refusal with a pier section P(x−1) being indicated as the penultimate pier section driven into the ground to the point of refusal. As indicated in FIG. 19D, after the point of refusal has been reached, structure S' is elevated on final pier section Px with respect to a reference level RL on supporting means, such as ground G, bolts 122 are set, the lifting assembly is removed, and pier section Px is cut off flush with end 120 of sleeve 40'. Pier section P(x+1) is then formed by cutting pier section Px and is removed. Stop plate 130 is interposed between ends 116 and 118 of abutment elements 112 and 114 and end 120 of sleeve 12' to support structure S' on the piers via bracket 40'.

Figure 19E:
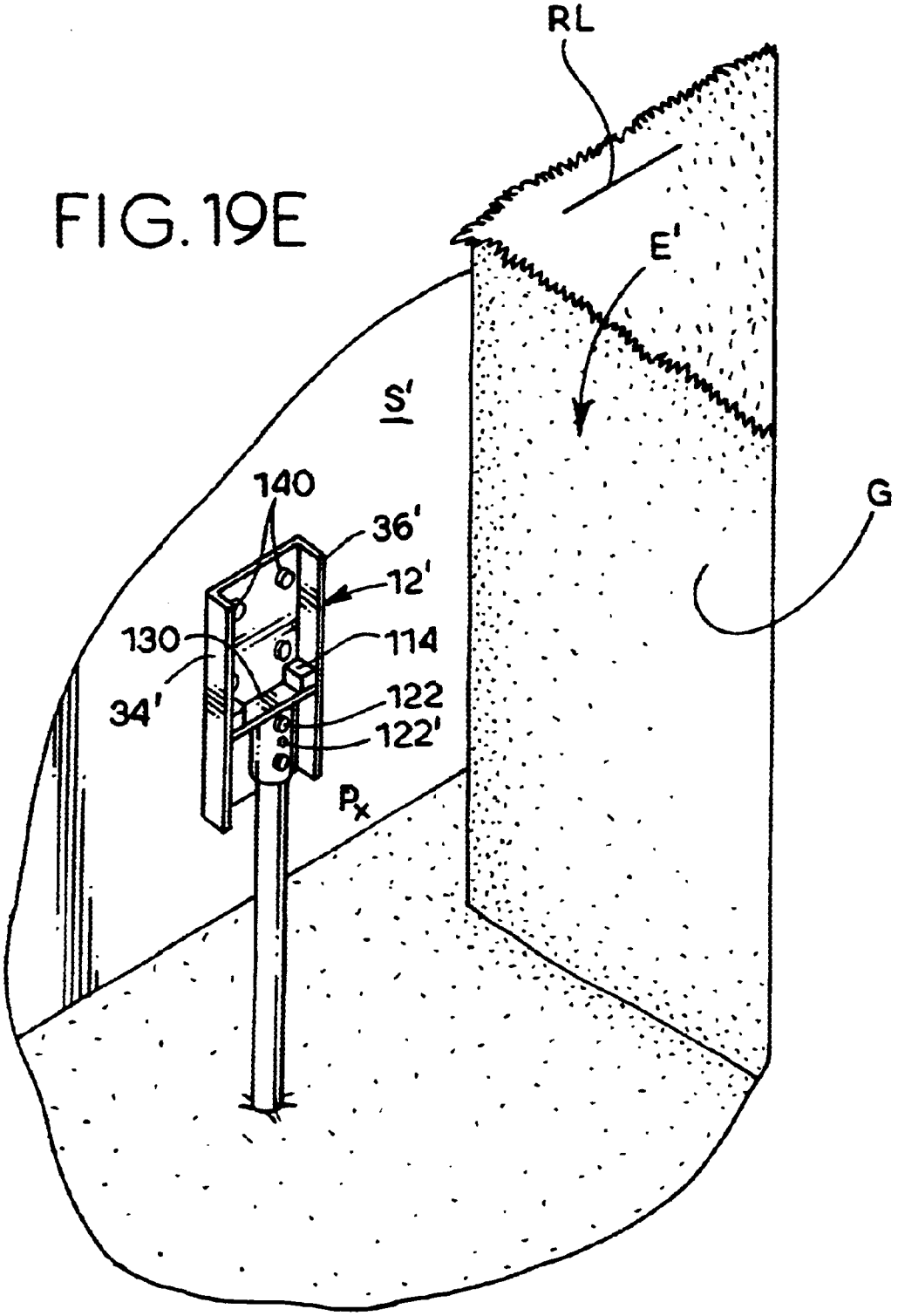
FIG. 19E shows a step in the method using the alternative form of the bracket in which the structure-affixed bracket is fixed to the pier assembly to support the structure in the desired elevated position with respect to the ground.

As illustrated in FIG. 19E, further fasteners, such as bolts 140 are used to fixedly attach bracket 12' to structure S'. Fasteners 122 can be left in place if desired. An additional fastener can be used in some instances and is indicated in FIG. 19E as extra fastener 122'. The extra fastener is indicated in FIG. 19E only as an alternative form of the system 10' and is not needed in all cases but is shown only for the purpose of completeness. Excavation E' can be backfilled and landscaped as discussed in the referenced West, et al. patent.

Figure 14:
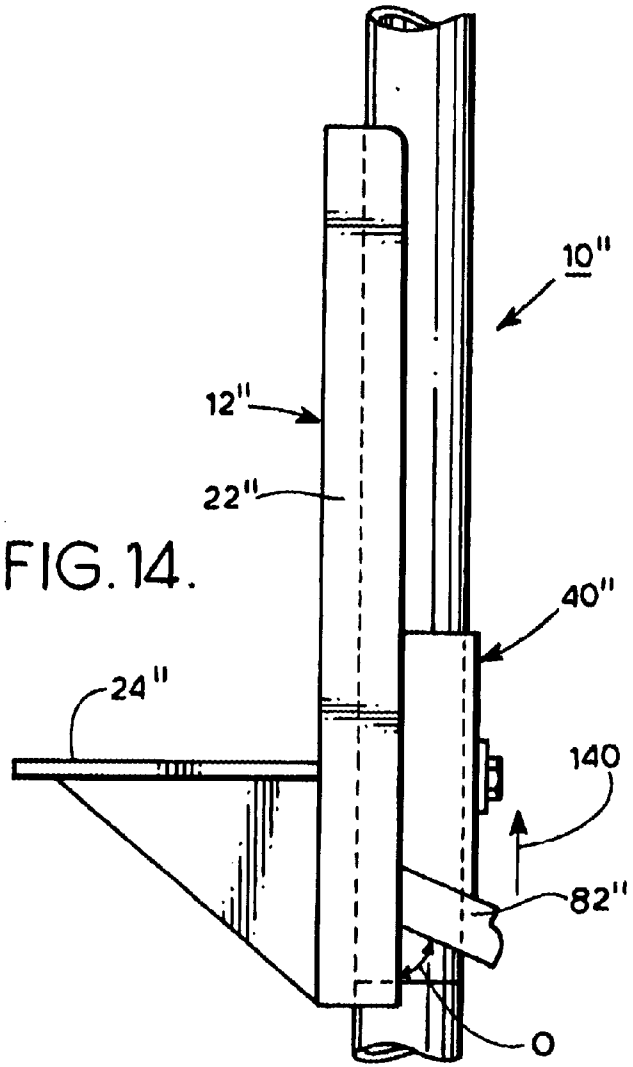
FIG. 14 is side elevational view of an alternative form of the bracket having an angled bottom shoe.

Yet another alternative form of the structure elevating system is shown in FIG. 14 as system 10". System 10" is identical to system 10 in all respects except bracket 12" of system 10" includes a bottom shoe 82" that is oriented at an oblique angle with respect to body 22" of bracket 12" when lifting assembly 14" is attached to bracket 12". By being oriented at an oblique angle with respect to the body of bracket 12", bottom shoe 82" directs force during pier driving from the lifting assembly upwardly as indicated by arrow 140 to enhance the attachment between ledge 24" and the structure being elevated. The preferred form of bracket 12" includes an angle of between 120 and 130. However, other angles can be used without departing from the scope of the present disclosure. As will be understood from the teaching of this disclosure, bracket 12" can also be used in conjunction with system 10' by removing ledge 24" and carrying out the method described above with regard to FIGS. 19A–19E.

Figure 17:
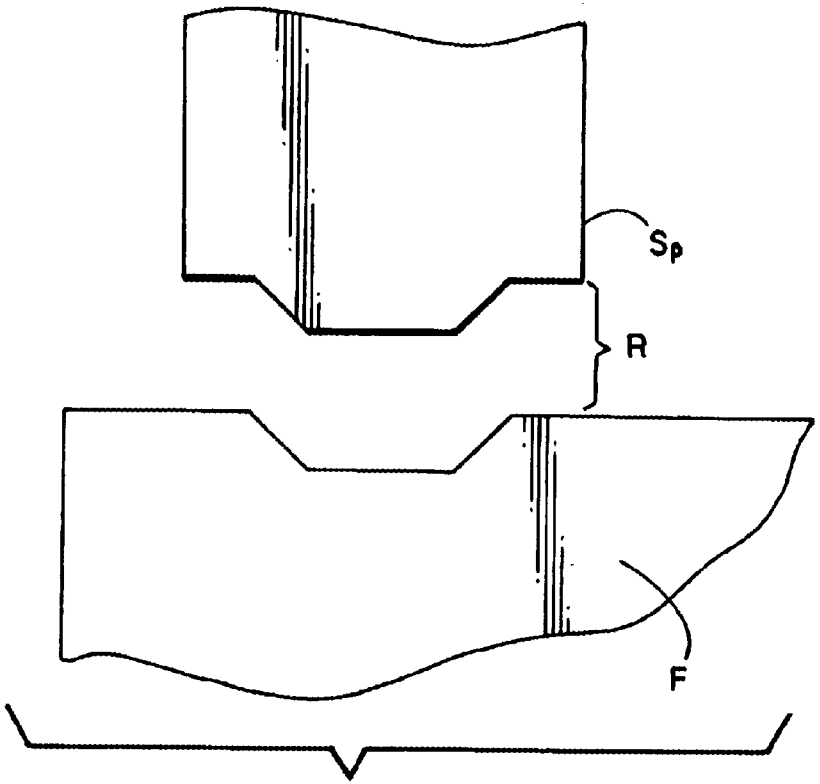
FIG. 17 is an elevational view of a simple situation in which a foundation has fallen away from the rest of the structure.

As discussed above, some jobs are quite simple. The system disclosed herein is amenable to such easy jobs. One such job includes a situation where a basement or a foundation wall has simply dropped away from the remainder of the structure. This situation is illustrated in FIG. 17 where foundation F has dropped a distance R below a properly located structure Sp. Any of the systems 10, 10' or 10" can be used to raise foundation F back into a desired position with respect to the bottom of structure Sp.

It is understood that while certain forms of the present invention have been illustrated and described herein, it is not to be limited to the specific forms or arrangements of parts described and shown.

II. Skeletal Structural System 4

It is to be understood that while certain forms of the present invention have been illustrated and described herein, it is not to be limited to the specific forms or arrangement of parts described and shown.

What is claimed and desired to be secured by Letters Patent is as follows:

1. A structure jacking system, which includes:

a) a support bracket including a body, an extension extending in a first direction from said body and a guide sleeve mounted on said body and accessible from a second direction opposite said first direction, said extension having an extension upper surface engageable with a lower surface of a structure to be lifted, said extension upper surface including a roughened area thereon for inhibiting relative movement between said extension upper surface and the lower surface of the structure;

b) a lifting assembly with upper and lower ends and including a lifting head at said upper end and a connecting frame at said lower end; and c) a pipe pier extending through said guide sleeve and adapted for driving engagement by said lifting head; wherein d) said system has a lift configuration with said support bracket connected to said connecting frame and a support configuration with said support bracket connected to said pipe pier.

2. The structure jacking system as in claim 1, wherein said body comprises a channel member with a web connected to said extension and a pair of flanges extending from said web in said second direction.

3. In a structure jacking system having a lifting assembly with upper and lower ends, a drive head connected to the upper end and a cage connected to the lower end, the cage for connecting the lifting assembly to a structure engaging bracket attachable to a structure to be raised, the lifting assembly receiving a pier to be driven downwardly adjacent the structure by the drive head until the structure is raised to a predetermined level, the pier being securable to the structure engaging bracket to retain the structure at the predetermined level; an improved structure engaging bracket comprising:

a) an upright channel member having a web and, a pair of side flanges extending outwardly from said web in a first direction along opposed sides thereof;

b) a guide sleeve connected to said web between said side flanges and having an aperture sized to slidably receive the pier; and c) means for engaging said structure to be raised.

wherein said means for engaging comprises a ledge connected to said web and extending outwardly therefrom in a second direction opposite said first direction, said ledge having a ledge upper surface for engaging a lower surface of the structure, and wherein said ledge upper surface includes at least one roughened area thereon for inhibiting relative movement between said ledge upper surface and the lower surface of the structure.

4. The structure engaging bracket as in claim 3, wherein said means for engaging comprises one or more holes passing through said web and one or more fasteners receivable through said holes and engageable with a vertical surface of said structure.

5. In a structure jacking system having a lifting assembly with upper and lower ends, a drive head connected to the upper end and a cage connected to the lower end, the cage for connecting the lifting assembly to a structure engaging bracket attachable to a structure, the lifting assembly receiving a pier to be driven downwardly adjacent the structure by the drive head until the structure is raised to a predetermined level, the pier being securable to the structure engaging bracket to retain the structure at the predetermined level; an improved structure engaging bracket comprising:

a. an upright channel member having a web and a pair of side flanges extending outwardly from said web in a first direction along opposed sides thereof;

b. a guide sleeve connected to said web between said side flanges and having an aperture sized to slidably receive the pier;

c. a ledge connected to said channel member and extending outwardly therefrom in a second direction opposite said first direction, said ledge having a ledge upper surface for engaging a lower surface of the structure, said ledge upper surface having at least one roughened area thereon for inhibiting relative movement between said ledge upper surface and the lower surface of the structure.

6. In a structure jacking system having a lifting assembly with upper and lower ends, a drive head connected to the upper end and a cage connected to the lower end, the cage for connecting the lifting assembly to a structure engaging bracket attachable to a structure, the lifting assembly receiving a pier to be driven downwardly adjacent the structure by the drive head until the structure is raised to a predetermined level, the pier being securable to the structure engaging bracket to retain the structure at the predetermined level; an improved structure engaging bracket comprising:

a base having a wall with side flanges extending in a first direction;

a. a guide sleeve connected to said wall between said side flanges and having an aperture sized to slidably receive the pier;

a ledge connected to said base and extending outwardly therefrom in a second direction opposite said first direction, said ledge having a ledge upper surface for engaging a lower surface of the structure, said ledge upper surface having at least one roughened area thereon for inhibiting relative movement between said ledge upper surface and the lower surface of the structure.

* * * * *